US007987944B1

(12) United States Patent
Brittingham et al.

(10) Patent No.: US 7,987,944 B1
(45) Date of Patent: Aug. 2, 2011

(54) FIREARM SOUND SUPPRESSOR BAFFLE

(75) Inventors: Kevin Brittingham, Dacula, GA (US); Mike Smith, Alpharetta, GA (US); Hunter Terhune, Snellville, GA (US)

(73) Assignee: Advanced Armament Corp., LLC, Lawrenceville, GA (US)

( * ) Notice: Subject to any disclaimer, the term of this patent is extended or adjusted under 35 U.S.C. 154(b) by 0 days.

(21) Appl. No.: 12/853,980

(22) Filed: Aug. 10, 2010

(51) Int. Cl.
*F41A 21/00* (2006.01)

(52) U.S. Cl. ..... 181/223; 89/14.4

(58) Field of Classification Search ..... 181/223; 89/14.2, 14.3, 14.4
See application file for complete search history.

(56) References Cited

U.S. PATENT DOCUMENTS

| | | | | | |
|---|---|---|---|---|---|
| 3,114,289 | A * | 12/1963 | Aulabaugh | 89/14.3 |
| 4,576,083 | A * | 3/1986 | Seberger, Jr. | 89/14.4 |
| 4,588,043 | A * | 5/1986 | Finn | 181/223 |
| 4,907,488 | A | 3/1990 | Seberger | |
| 4,930,396 | A * | 6/1990 | Johnson | 89/14.3 |
| 5,029,512 | A * | 7/1991 | Latka | 89/14.4 |
| 5,164,535 | A * | 11/1992 | Leasure | 89/14.4 |
| 5,679,916 | A * | 10/1997 | Weichert | 89/14.4 |
| 6,308,609 | B1 * | 10/2001 | Davies | 89/14.4 |
| 6,374,718 | B1 * | 4/2002 | Rescigno et al. | 89/14.4 |
| 6,575,074 | B1 * | 6/2003 | Gaddini | 89/14.4 |
| 6,820,530 | B2 * | 11/2004 | Vais | 89/14.3 |
| 7,237,467 | B1 * | 7/2007 | Melton | 89/14.4 |
| 7,308,967 | B1 * | 12/2007 | Hoel | 181/223 |
| 7,412,917 | B2 * | 8/2008 | Vais | 89/14.4 |
| 7,530,299 | B1 * | 5/2009 | Poff | 89/14.3 |

* cited by examiner

*Primary Examiner* — Jeremy Luks
(74) *Attorney, Agent, or Firm* — Wood, Herron & Evans, LLP

(57) ABSTRACT

A baffle configured for use in a firearm sound suppressor is disposed along a longitudinal axis that defines a path of travel for a projectile moving from a rearward side to a forward side. The baffle includes a rear bell portion having a first annular exterior surface and a forward bell portion having a second annular exterior surface. Along the longitudinal axis in a forward direction, the rear bell portion decreases in cross-section and the forward bell portion increases in cross-section. The baffle further includes a waist portion connecting the rear bell portion and the forward bell portion. A central bore extends along the longitudinal axis through the rear bell portion and defines an annular interior surface which is sized to receive a projectile traveling along the longitudinal axis. The baffle may be one of a plurality of baffles in a baffle stack.

21 Claims, 10 Drawing Sheets

FIREARM SOUND SUPPRESSOR BAFFLE

TECHNICAL FIELD

This invention generally relates to fluid flow baffles and more particularly to a baffle for use in a firearm sound suppressor.

BACKGROUND

It is known that firearm sound suppressors or "silencers" reduce or modify the amount of recoil or kickback and the sound level of a muzzle blast (caused by the discharge of pressurized burning gases from the firearm). Conventional firearm sound suppressors include a generally tubular housing with a series of baffles inside the housing to redirect and delay the release of the pressurized gases. These baffles can have various shapes and profiles to more effectively disperse the burning gases and lower the sound level of a muzzle blast.

One typical conventional baffle is referred to as a "K-baffle," an example of which is shown in FIGS. 1A and 1B. The K-baffle 400 is generally defined by a rear plate portion 402 that is generally flat and oriented transverse to the axial bore of the suppressor and a forward bell portion 404 extending in a forward direction from the rear plate portion 402 along the longitudinal axis of the K-baffle 400. The rear plate portion 402 includes a central aperture 406 for a projectile to pass through the K-baffle 400 in the forward direction. The forward bell portion 404 increases in annular cross-section from the central aperture 406 and rear plate portion 402 to a forward end 408, which is configured to abut a rear plate portion 402 of a subsequent K-baffle 400. Thus, the K-baffle 400 defines an interior chamber 410 within the forward bell portion 404 and an exterior chamber 412 between the rear plate portion 402 and the forward bell portion 404 outside of the forward bell portion 404. The interior chamber 410 and exterior chamber 412 is typically fluidly connected by a flow aperture 414 cut into the forward bell portion 404. Consequently, a plurality of K-baffles 400 defines a plurality of blast chambers 410, 412 for the burning gases to expand into during firing of the firearm, thereby reducing the noise output of a muzzle blast.

One problem that has been known to occur with the use of K-baffles 400 is the potential for the rear plate portion 402 to fail and be buckled forward either by a single powerful blast or over time by the repeated impact of high-pressure burning gases against the rear plate portion 402. If the rear plate portion 402 bends toward the forward bell portion 404, the effectiveness of the sound suppressor is severely compromised, to say the least. Furthermore, a buckling of the rear plate portion 402 may also affect the central aperture 406 in such a way that a projectile may not safely be fired through the sound suppressor.

Therefore, it would be desirable to improve the baffles used in a firearm sound suppressor and address some of the problems with conventional baffles.

SUMMARY

According to one embodiment of the present invention, a baffle configured for use in a firearm sound suppressor is disposed along a longitudinal axis that defines a path of travel for a projectile moving from a rearward side to a forward side. The baffle includes a rear bell portion having a first annular exterior surface. The rear bell portion decreases in cross-section along the longitudinal axis toward the forward side. The baffle also includes a forward bell portion including a second annular exterior surface. The forward bell portion increases in cross-section along the longitudinal axis toward the forward side. The baffle further includes a waist portion defined between and connecting the rear bell portion and the forward bell portion. A central bore extends along the longitudinal axis at least substantially through the rear bell portion. The central bore defines an annular interior surface which is sized to receive a projectile traveling along the longitudinal axis.

In some embodiments, the baffle further includes a flow aperture disposed through the waist portion to enable fluid communication between the central bore and an exterior chamber. The exterior chamber is at least partially defined by the first and second annular exterior surfaces. The forward bell portion includes a forward end and is hollowed to define a forward bell interior surface extending from the forward end to the waist portion. The rear bell portion includes a rear end with an outer peripheral edge, and the central bore includes a rear peripheral edge. An annular first groove is cut into the rear bell portion between the outer peripheral edge of the rear bell portion and the rear peripheral edge of the central bore. Additionally, a pair of partially-annular second grooves may be cut deeper into the rear bell portion from the first groove.

A first cross-flow groove may be cut deeper into the rear bell portion from the first groove between the pair of second grooves. The first cross-flow groove is also cut through the annular interior surface of the central bore so that cross flow of fluid across the central bore toward the flow aperture is formed. The baffle also includes a second cross-flow groove in fluid communication with the flow aperture and cut into the waist portion and the rear bell portion from the forward bell interior surface so as to receive cross flow of fluid from the first cross-flow groove. The central bore may be sized for .22 caliber ammunition, .45 ACP caliber ammunition, 9×19 millimeter Parabellum ammunition, or any other size of ammunition.

In another embodiment of the present invention, a baffle stack is provided for use in a firearm sound suppressor having an outer tubular shell with an interior surface and extending along a longitudinal axis. The baffle stack includes a plurality of baffles configured to contact the interior surface of the outer tubular shell and disposed in series along the longitudinal axis. Each of the plurality of baffles includes a rear bell portion, a forward bell portion, a waist portion, a central bore, and a flow aperture, as described above. Furthermore, the axial rotational orientation of each successive baffle is identical in some embodiments. In other embodiments, each successive baffle is rotated 180 degrees in orientation from an adjacent baffle.

BRIEF DESCRIPTION OF THE DRAWINGS

The accompanying drawings, which are incorporated in and constitute a part of this specification, illustrate an embodiment of the invention and, together with a general description of the invention given below, serve to explain the principles of the invention. Like reference numerals are used to indicate like parts throughout the various figures of the drawing, wherein.

DETAILED DESCRIPTION

Figure 1A:
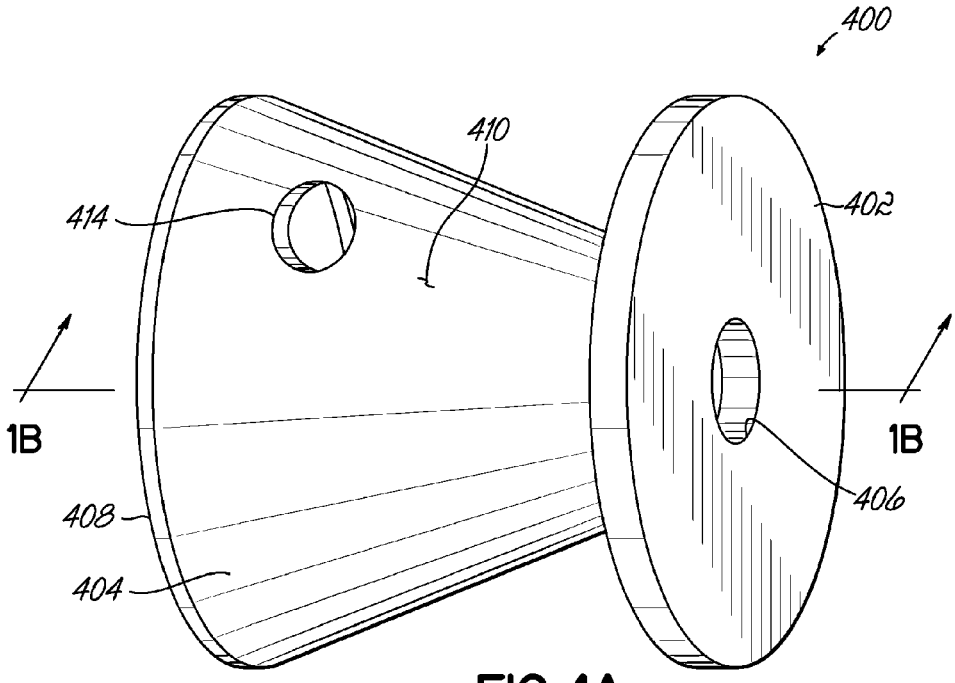
FIG. 1A PRIOR ART
FIG. 1A is a pictorial view of a conventional K-baffle for a firearm sound suppressor.
Figure 1B:
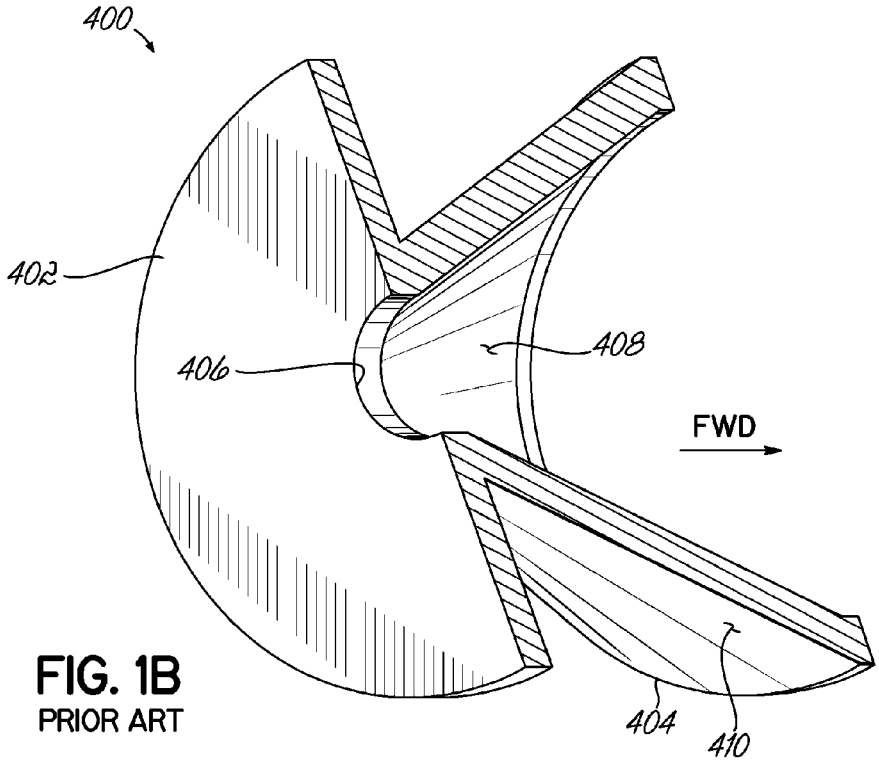
FIG. 1B PRIOR ART
FIG. 1B is another pictorial view of the conventional K-baffle of FIG. 1A.
Figure 2:
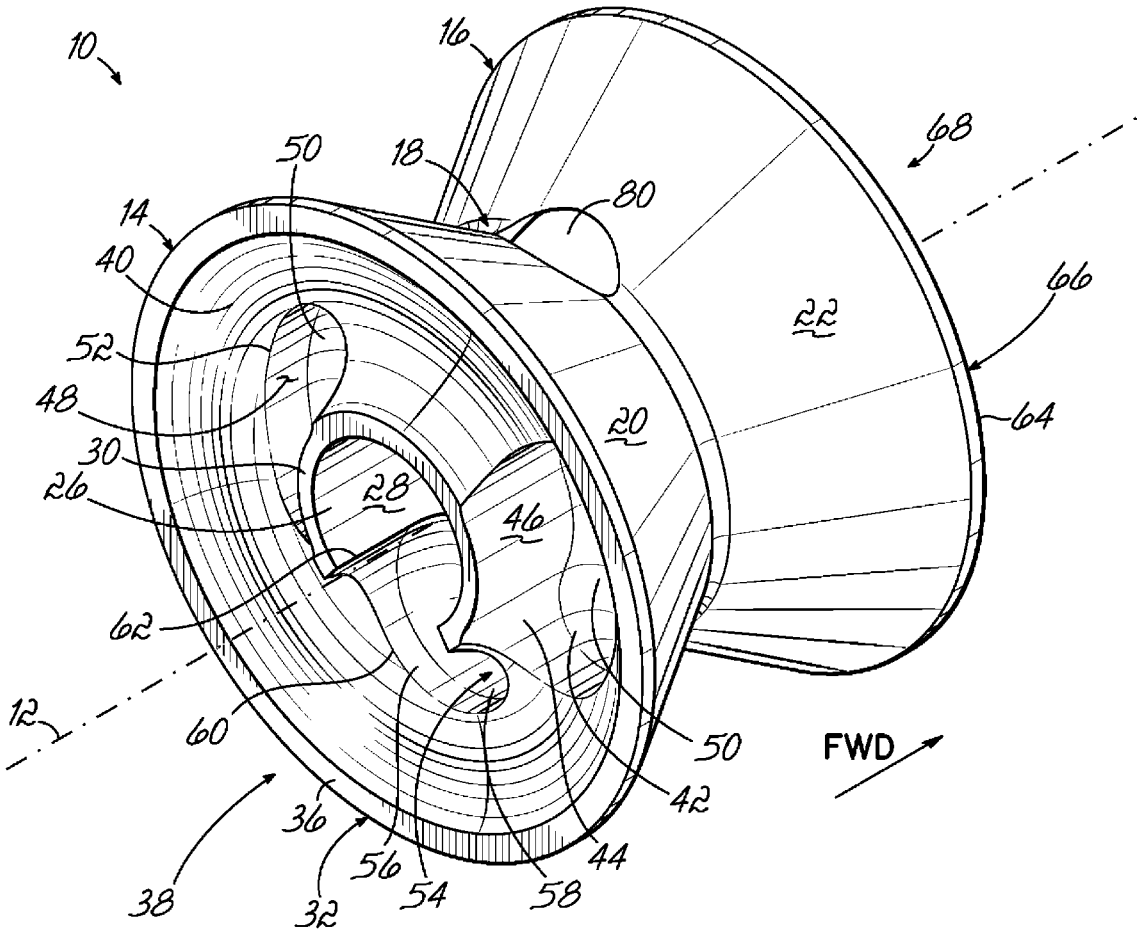
FIG. 2 is a pictorial view of a first embodiment of a baffle for a firearm sound suppressor.
Figure 3:
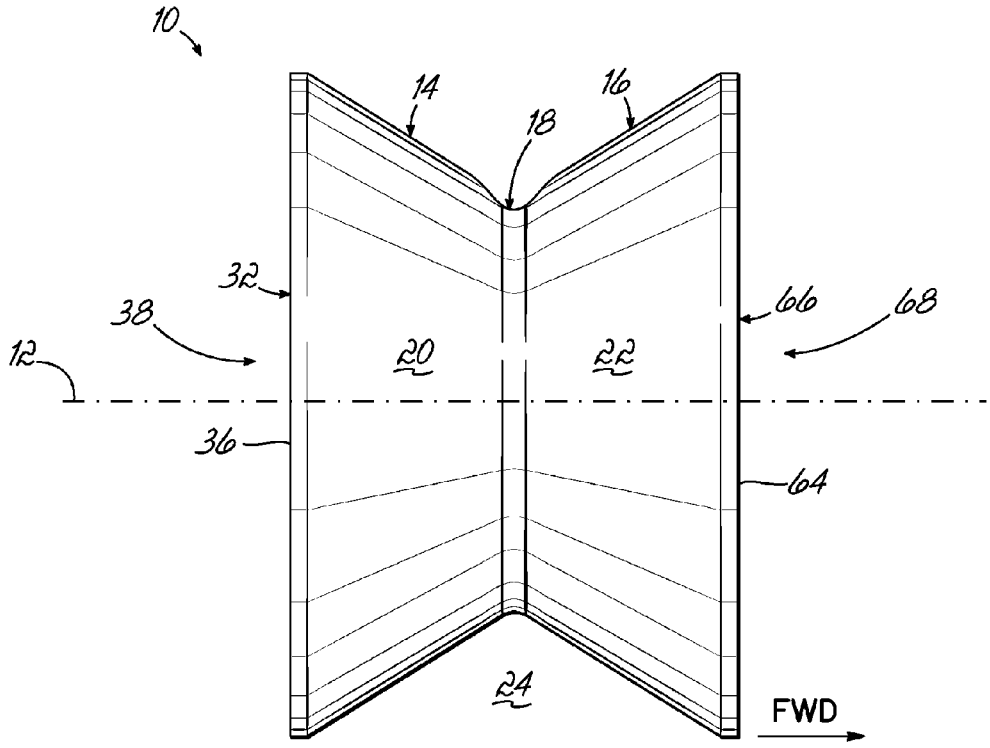
FIG. 3 is a side elevation view of the baffle of FIG. 2.
Figure 4:
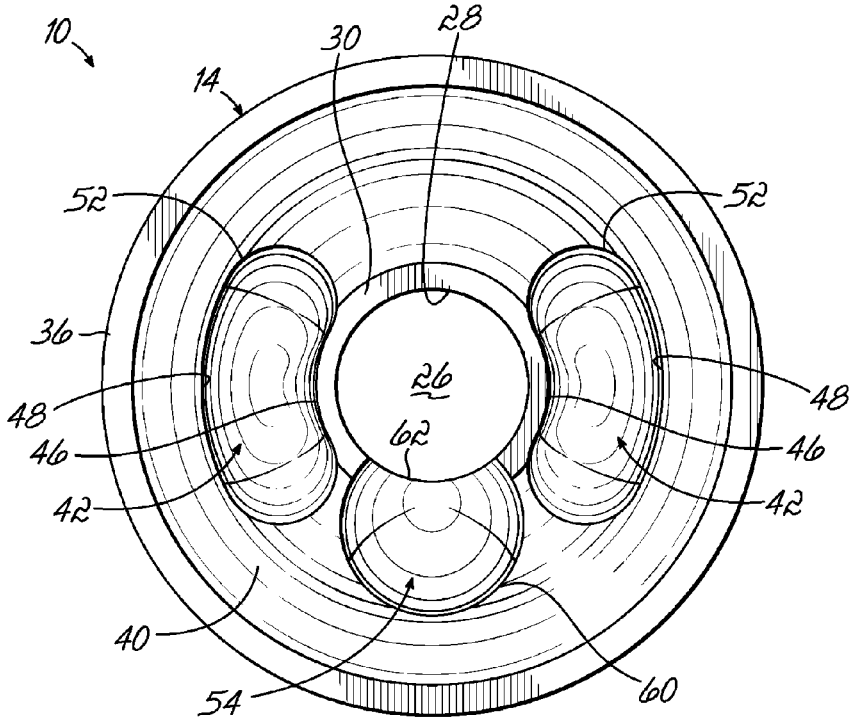
FIG. 4 is a rear elevation view of the baffle of FIG. 2.
Figure 5:
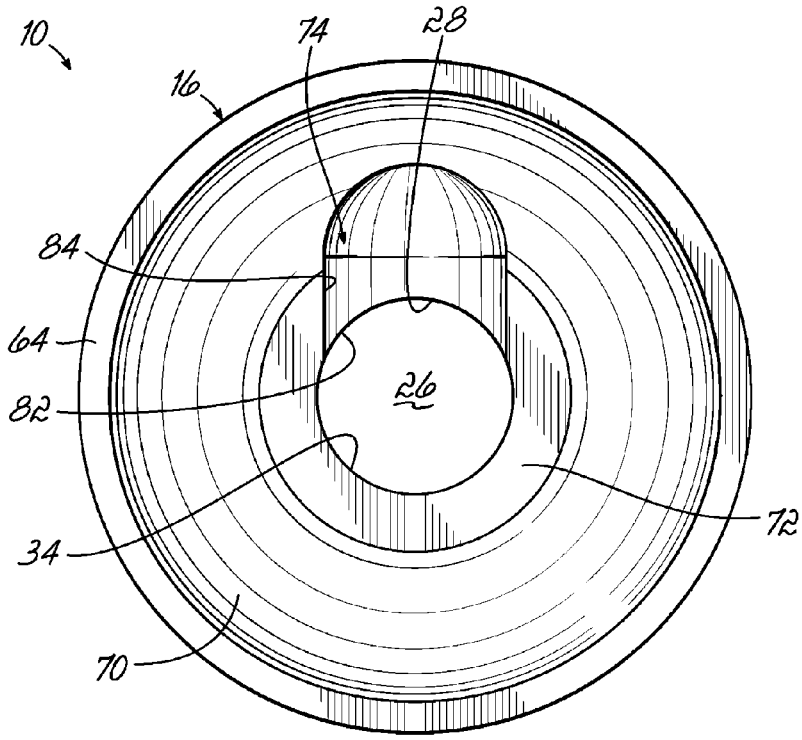
FIG. 5 is a front elevation view of the baffle of FIG. 2.
Figure 6:
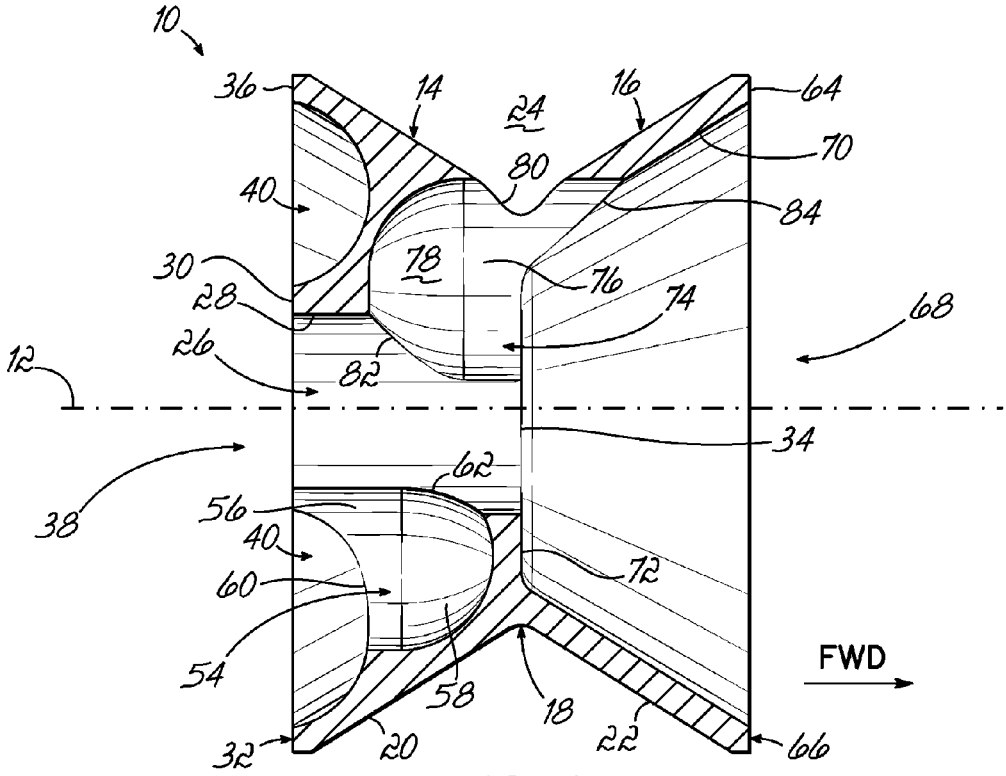
FIG. 6 is a longitudinal sectional side view of the baffle of FIG. 2.

Referring to FIGS. 2-7, a first embodiment of a baffle 10 for use in a firearm sound suppressor is illustrated. The baffle 10 is configured to permit a fired projectile to freely pass through the baffle 10 in a forward direction along a longitudinal axis 12, while dispersing the flow of high-pressure burnt or burning gases through the sound suppressor. Unlike the conventional K-baffle 400 illustrated in FIGS. 1A and 1B, the baffle 10 replaces the rear plate portion 402 with a rear bell portion 14 that generally decreases in external cross-section in a forward direction along the longitudinal axis 12. The curved or angled rear bell portion 14 provides more strength to resist the repeated impacts of highly-pressurized burning gases while also improving the overall gas dispersion in a sound suppressor. Although one of ordinary skill in the art will appreciate that the baffle 10 may be modified for any size or caliber or ammunition round, the baffle 10 of the first embodiment will be described with reference to .22 caliber ammunition.

In addition to the rear bell portion 14, the baffle 10 includes a forward bell portion 16 and a waist portion 18. The forward bell portion 16 increases in external cross-section in a forward direction along the longitudinal axis 12. The waist portion connects the rear bell portion 14 and the forward bell portion 16 at their respective smallest cross-sections such that the baffle 10 has an overall X-shaped profile as most clearly shown at FIG. 3. In this regard, the rear bell portion 14 and the forward bell portion 16 are generally frusto-conical in shape and extend away from the waist portion 18 for approximately the same longitudinal length. The rear bell portion 14 includes a first annular exterior surface 20, and the forward bell portion 16 includes a second annular exterior surface 22. The first and second annular exterior surfaces 20, 22 cooperate to define an external blast chamber 24 in which high-pressure burning gases may expand within an assembled sound suppressor (not shown).

The baffle 10 also includes a central bore 26 extending along the longitudinal axis and defining an annular interior surface 28. The central bore 26 extends substantially through the rear bell portion 14. In this regard, the central bore 26 extends from a rear peripheral edge 30 at a rear end 32 of the rear bell portion 14 to a forward peripheral edge 34 proximate to the waist portion 18. The central bore 26 is sized to permit .22 caliber ammunition projectiles to pass through the baffle 10 without compressing or otherwise affecting the path of the projectile.

As shown in FIGS. 2, 4, 6, and 7, the rear bell portion 14 defines an outer peripheral edge 36 at the rear end 32. The outer peripheral edge 36 of the rear bell portion 14 and the rear peripheral edge 30 of the central bore 26 are generally coplanar with a rearward side 38 of the baffle 10. The rear bell portion 14 includes an annular first groove 40 cut into the rear bell portion 14 toward the waist portion 18 and between the outer peripheral edge 36 and the rear peripheral edge 30 of the central bore 26. The annular first groove 40 is generally semicircular in cross-section (see FIG. 6) to define a curved surface from the outer peripheral edge 36 to the rear peripheral edge 30.

A pair of partially annular second grooves 42 is cut deeper into the rear bell portion 14 from the first groove 40 toward the waist portion 18. The second grooves 42 have a smaller cross-section in the axial direction than the first groove 40 such that the second grooves 42 can extend closer to the waist portion 18 than the first groove 40. The second grooves 42 include a shallow portion 44 having generally flat inner and outer sidewalls 46, 48 and a deep portion 50 having a generally semicircular cross-section (see FIG. 6). The inner sidewalls 46 and outer sidewalls 48 are substantially parallel to the longitudinal axis 12. Each shallow portion 44 extends between the deep portion 50 and a groove edge 52 defined at the junction of the first groove 40 with the respective second groove 42. Each inner sidewall 46 extends from the rear peripheral edge 30 of the central bore 26 to the respective deep portion 50, and therefore defines a partially annular exterior surface of the central bore 26.

Figure 7:
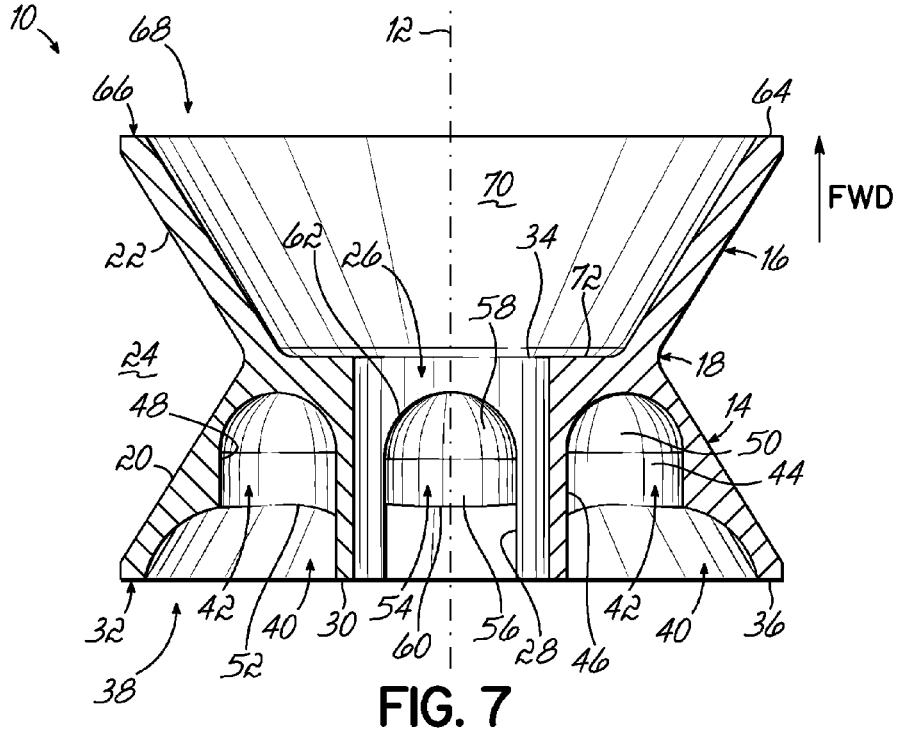
FIG. 7 is a longitudinal sectional top view of the baffle of FIG. 2.

The pair of second grooves 42 is spaced from each other on the top and bottom of the first groove 40. Between the pair of second grooves 42 on a bottom side of the first groove 40, a first cross-flow groove 54 is cut deeper into the rear bell portion 14 from the first groove 40. The first cross-flow groove 54 includes a generally cylindrical shallow portion 56 extending forwardly from the first groove 40 and a generally hemispherical deep portion 58 extending forwardly from the shallow portion 56. The first cross-flow groove 54 is also cut through the annular interior surface 28 of the central bore 26 such that the first cross-flow groove 54 is in fluid communication with the central bore 26. The first-cross flow groove 54 is defined between a first generally U-shaped edge 60 defined between the first cross-flow groove 54 and the first groove 40, and a second generally U-shaped edge edge 62 defined between the first cross-flow groove 54 and the annular interior surface 28 of the central bore 26. As shown most clearly in FIG. 6, the deep portion 58 of the first cross-flow groove 54 is proximate to the waist portion 18 of the baffle 10. In this regard, FIG. 7 illustrates that the deep portion 58 of the first cross-flow groove 54 and the deep portions 50 of the second grooves 42 extend to about the same depth within the rear bell portion 14.

With particular reference to FIGS. 2 and 5-7, the forward bell portion 16 of the baffle 10 includes an outer peripheral edge 64 at a forward end 66 that defines a forward side 68 of the baffle 10. The forward bell portion 16 is hollowed out to define a forward bell interior surface 70 and an annular interior surface 72 at the waist portion 14. The forward bell interior surface 70 is adjacent to the second annular exterior surface 22. The annular interior surface 72 surrounds the forward peripheral edge 34 of the central bore 26. Thus, when a .22 caliber projectile is fired through the baffle 10, the projectile passes through the central bore 26 and then passes through the hollowed forward bell portion 16.

A second cross-flow groove 74 is cut from the forward bell interior surface 70 through the waist portion 18 and into the rear bell portion 14 of the baffle 10. The second cross-flow groove 74 includes a generally cylindrical shallow portion 76 extending rearwardly from the forward bell interior surface 70 and a generally hemispherical deep portion 78 extending rearwardly from the shallow portion 76. The second cross-flow groove 74 is also cut through the annular interior surface 28 of the central bore 26 such that the second cross-flow groove 74 is in fluid communication with the central bore 26. The generally cylindrical shallow portion 76 also cuts through the first and second annular exterior surfaces 20, 22 adjacent to the waist portion 18 to define a flow aperture 80 disposed generally through the waist portion 18. The flow aperture 80 enables fluid communication between the central bore 26 and the external blast chamber 24 as most clearly shown in FIG. 6. The generally hemispherical deep portion 78 is disposed between the pair of second grooves 42 in the rear bell portion 14 near the top of the first groove 40. The second cross-flow groove 74 includes a third generally U-shaped edge 82 at the annular interior surface 28 of the central bore 26 and a fourth generally U-shaped edge 84 (viewed from the forward side 68) at the forward bell interior surface 70. The second cross-flow groove 74 generally faces the first cross-flow groove 54 such that burning gases will travel from the first cross-flow groove 54 to the second cross-flow groove 74.

In operation, the baffle 10 disperses heat and pressure in the burning gases accompanying a fired projectile in multiple ways. When pressurized gases enter the rear bell portion 14 of the baffle 10, the overall flow is divided by the central bore 26, the first groove 40, and the first cross-flow groove 54. The portion of the gases redirected into the first groove 40 is forced to move transversely within the first groove 40, into the second grooves 42, or back towards the rear end 32 of the rear bell portion 14. The sharp edges 30, 52 between the central bore 26, the first groove 40, and the second groove 42 create more turbulent flow of pressurized gases, which contributes to reducing the heat and kinetic energy in the overall flow. The portion of the flow redirected into the first cross-flow groove 54 is forced immediately in a transverse direction across the longitudinal flow of pressurized gases following the projectile through the central bore 26. This cross flow of gases disrupts the generally linear flow of gases through the central bore 26 of the baffle 10, and also provides flow directed toward the flow aperture 80 and the external blast chamber 24. Pressurized gases also expand into the hollowed-out forward bell portion 16. Consequently, the baffle 10 absorbs heat and kinetic energy of pressurized burning gases flowing from a muzzle of a firearm by allowing the gases to expand, breaking up the flow of gases, creating turbulence and cross-flows in the gases, and separating the gases into different areas or chambers defined by the baffle 10.

Figure 8:
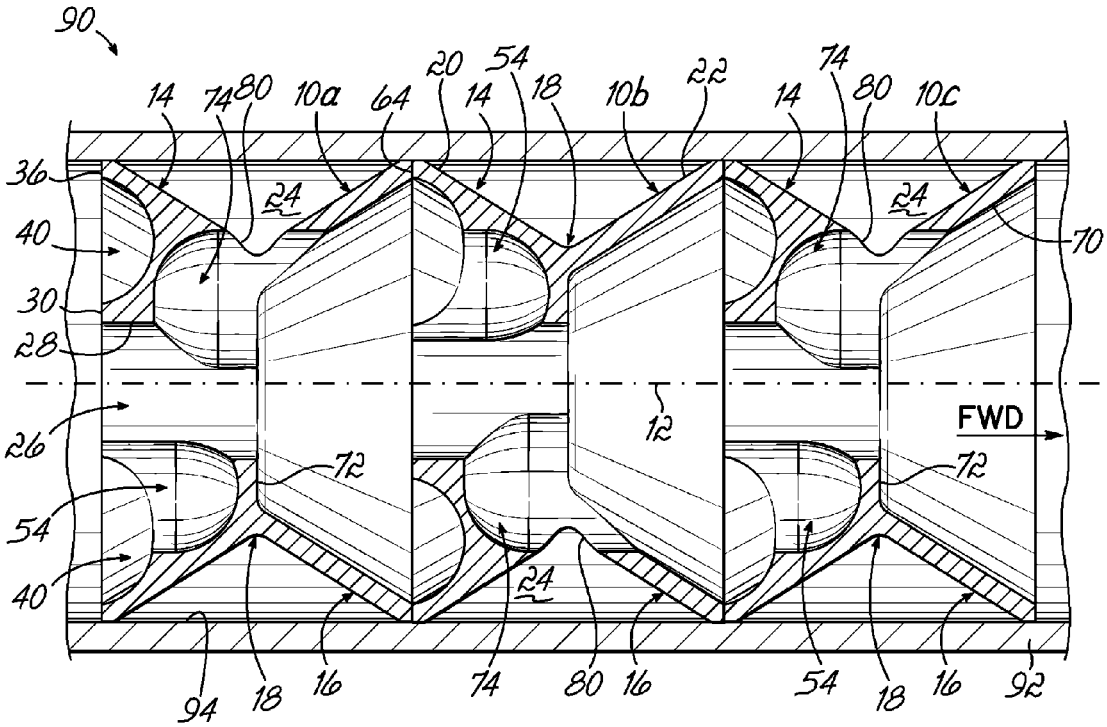
FIG. 8 is a longitudinal sectional side view of a baffle stack including multiple baffles of the embodiment of FIGS. 2-7.

FIG. 8 illustrates one embodiment of a baffle stack 90 for use in a firearm sound suppressor. The baffle stack 90 is illustrated with three baffles 10*a*, 10*b*, 10*c* of the first embodiment illustrated in series along the longitudinal axis 12, although one of ordinary skill in the art will recognize that the baffle stack 90 may include more or fewer baffles 10 within the scope of this invention. The firearm sound suppressor includes an outer tubular shell 92 with an interior surface 94 disposed about the longitudinal axis 12. Each of the baffles 10*a*, 10*b*, 10*c* is coupled to or slid into contacting engagement with the interior surface 94 of the outer shell 92, such that the forward end 66 of a first baffle 10*a* is adjacent to the rear end 32 of a second baffle, and so on. The baffles 10*a*, 10*b*, 10*c* include all of the features previously described with respect to FIGS. 2-7. For each baffle 10, respective external blast chambers 24 are completely defined by an annular space between the first annular exterior surface 20, the second annular exterior surface 22, and the interior surface 94 of the outer shell 92. FIG. 8 also illustrates that as pressurized gases expand in the forward bell portion 16 of a first baffle 10*a*, the gases are directed immediately into the central bore 26, first groove 40, and first cross-flow groove 54 of the second baffle 10*b*.

The first baffle 10*a* of the baffle stack 90 is generally referred to as a "blast baffle" because it is the first baffle to absorb pressure and heat from the burning gases expelled behind a fired projectile. In this embodiment, the first baffle 10*a* is formed from steel, while subsequent baffles 10*b*, 10*c* in the baffle stack 90 may be formed from aluminum. One of ordinary skill in the art will appreciate that in alternative embodiments, more of the baffles 10 in the baffle stack 90 may be formed from steel or other appropriate materials within the scope of this invention. For the .22 caliber ammunition baffles 10 of the first embodiment, each baffle 10 in the baffle stack 90 is rotated 180 degrees in orientation from the previous baffle 10, as shown in FIG. 8. Thus in the embodiment of FIG. 8, the first cross-flow groove 24 of the first baffle 10*a* directs flow generally upwardly, the first cross-flow groove 24 of the second baffle 10*b* directs flow generally downwardly, and so on. This rotating orientation of baffles 10 may help equalize the effect of any forces that the expanding pressurized gases apply to the baffle stack 90.

The baffle stack 90 may be operated in a dry condition or in a wet condition with liquid inserted into the baffle stack 90 to enhance the absorption of heat and kinetic energy. Additionally, the baffle stack 90 of this embodiment may be disassembled for cleaning out debris left by the fired projectile and the burning gases. Alternatively, the baffles 10 of the baffle stack 90 may be welded together, although it is usually preferred that a suppressor intended for use with .22 caliber ammunition be disassembleable. The baffle stack 90 advantageously utilizes most of the space within the outer shell 92 for the expansion of pressurized gases while redirecting and dividing the flow of gases into the various grooves 40, 42, 54 and chambers 24 as previously described. Although the X-shaped baffles 10 may be longer along the longitudinal axis 12 than conventional K-baffles, the X-shaped baffles 10 are stronger in resisting the forces of the pressurized burning gases and more effective in reducing the noise level of muzzle blast than a comparable length of K-baffles in a baffle stack.

Figure 9:
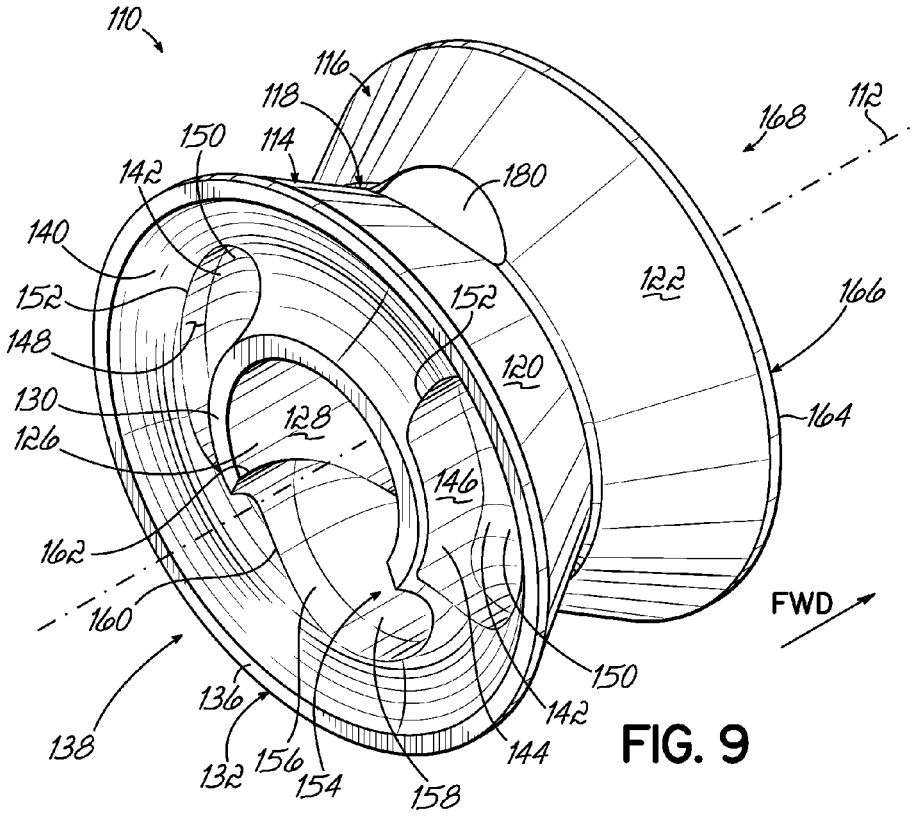
FIG. 9 is a pictorial view of a second embodiment of a baffle for a firearm sound suppressor.
Figure 10:
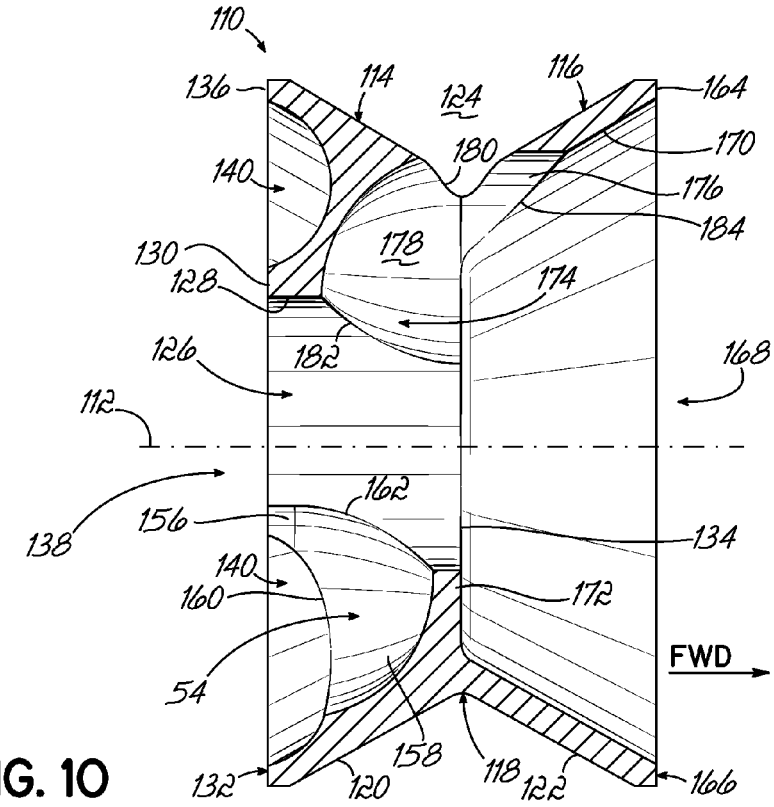
FIG. 10 is a longitudinal sectional side view of the baffle of FIG. 9.
Figure 11:
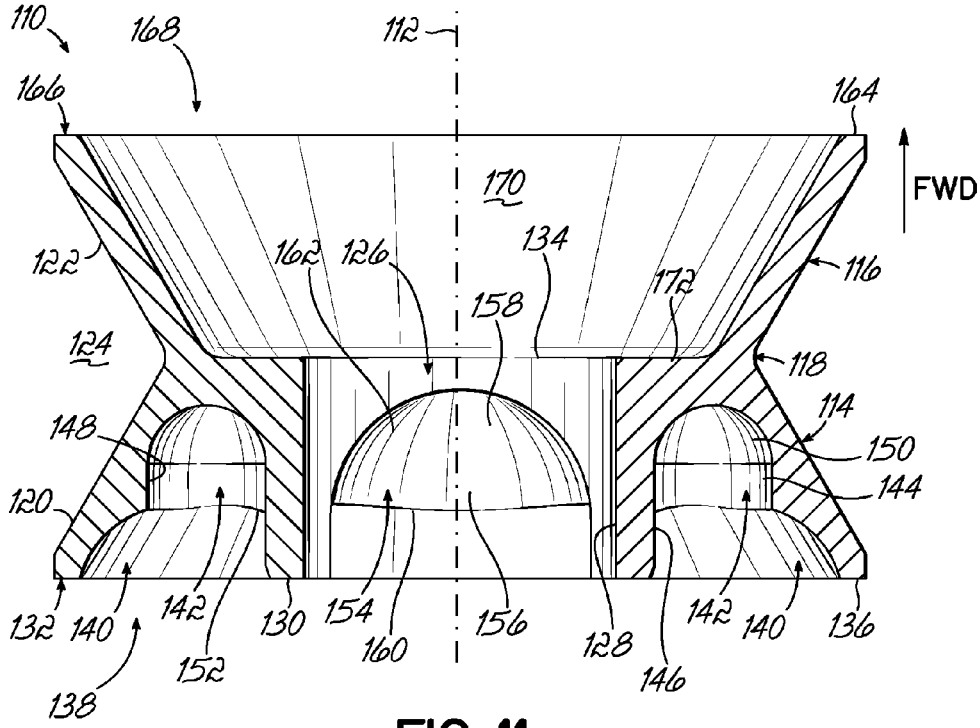
FIG. 11 is a longitudinal sectional top view of the baffle of FIG. 9.
Figure 12:
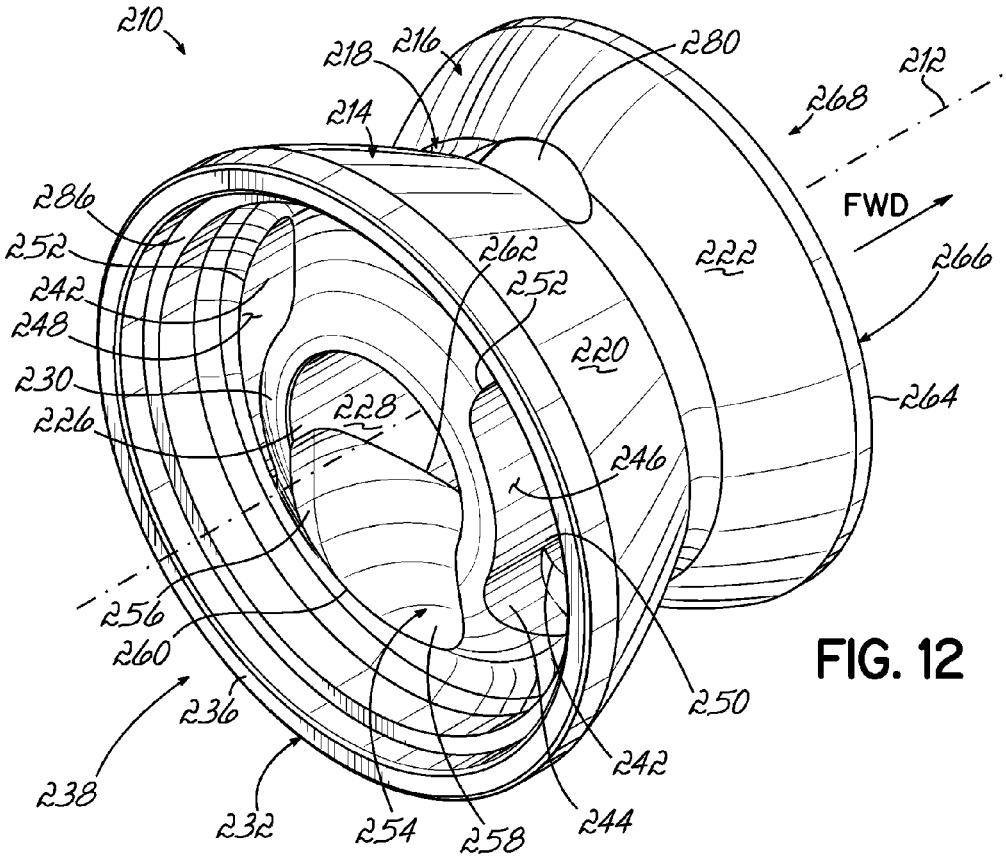
FIG. 12 is a pictorial view of a third embodiment of a baffle for a firearm sound suppressor.
Figure 13:
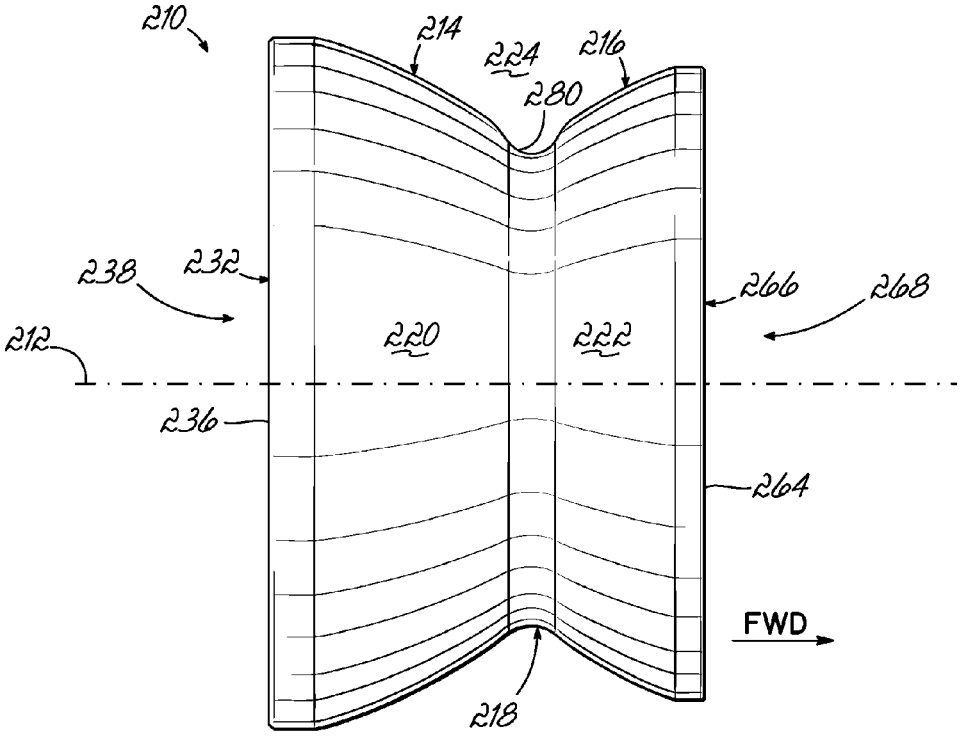
FIG. 13 is a side elevation view of the baffle of FIG. 12.
Figure 14:
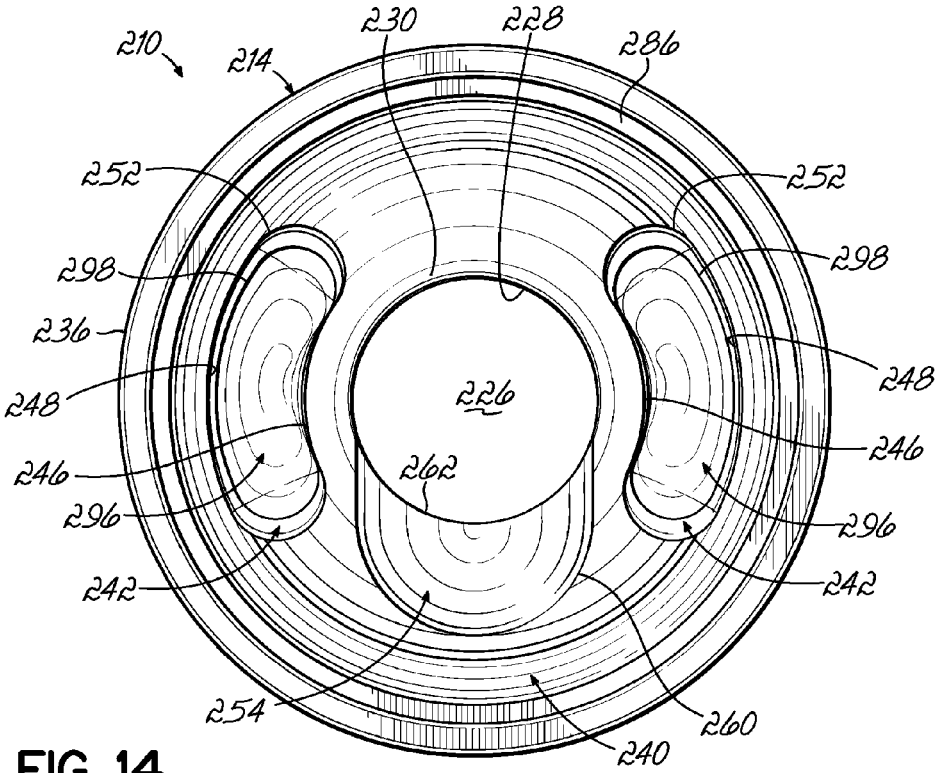
FIG. 14 is a rear elevation view of the baffle of FIG. 12.
Figure 15:
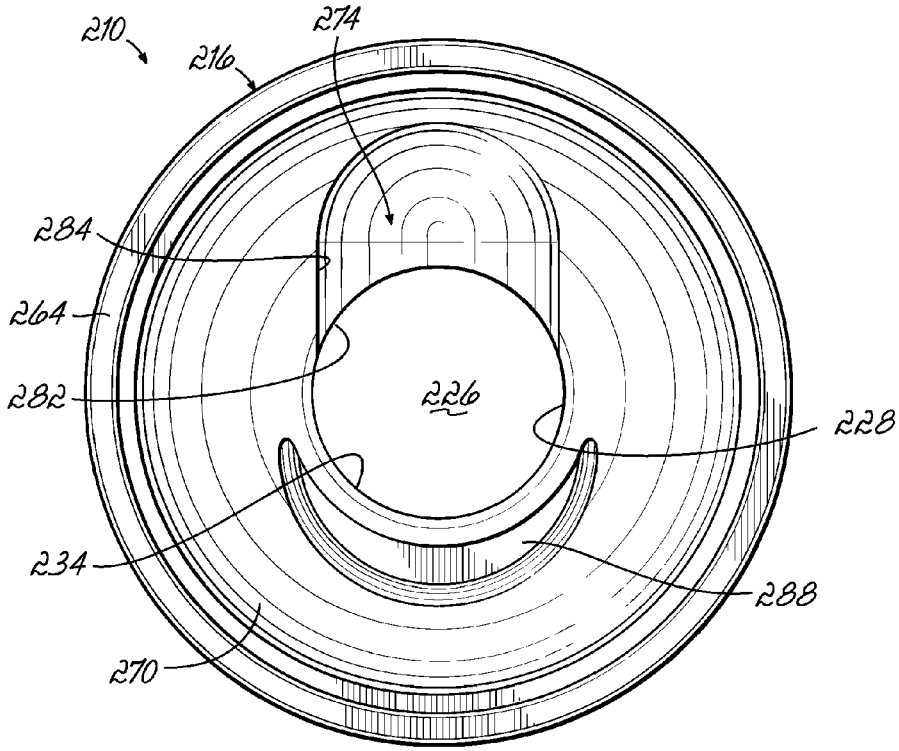
FIG. 15 is a front elevation view of the baffle of FIG. 12.
Figure 16:
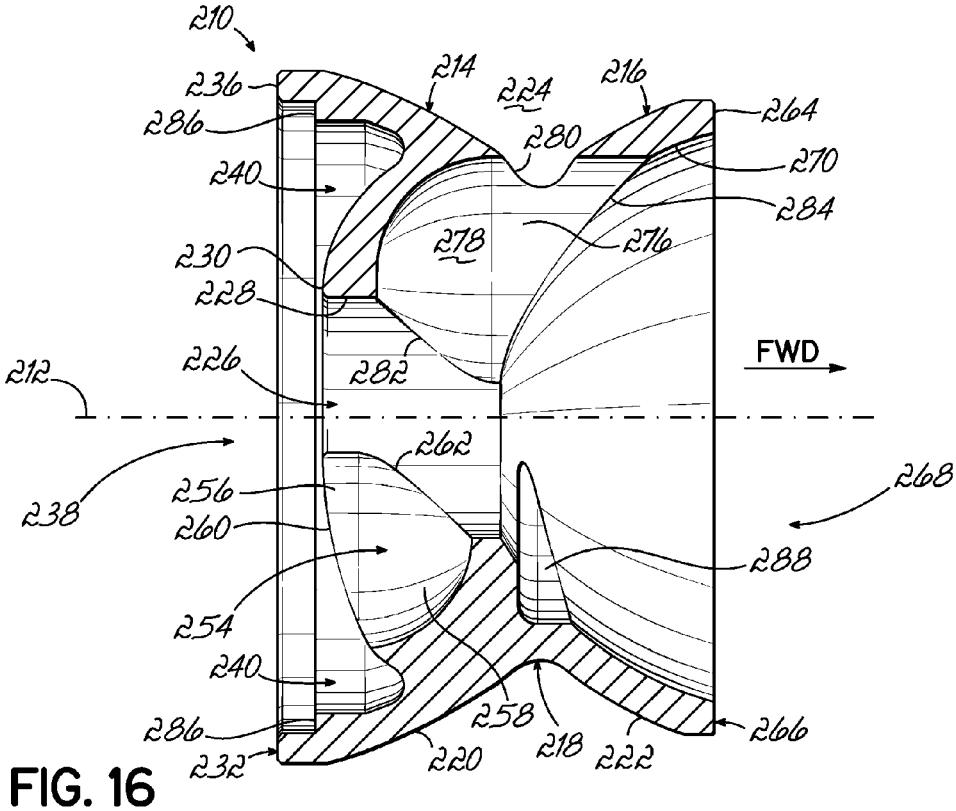
FIG. 16 is a longitudinal sectional side view of the baffle of FIG. 12.

A second embodiment of a baffle 110 for use in a firearm sound suppressor is illustrated in FIGS. 9-11. The baffle 110 is configured specifically for use with .45 ACP caliber ammunition, but one of ordinary skill in the art will appreciate that the baffle 110 could be designed for other projectile sizes. Conventional baffle designs have struggled to adequately suppress the noise of a .45 ACP projectile because the size of the fired projectile is much larger than a .22 caliber projectile, thereby requiring a much larger central passage through the baffle. However, the baffle 110 of the second embodiment includes most of the same elements previously described in detail in the first embodiment of the baffle 10, and these features also effectively reduce the noise level of a muzzle blast from a .45 ACP caliber firearm. Each of the elements repeated from the first embodiment of the baffle 10 are provided with the same reference number in the 100's (for example, the first cross-flow groove 154 of the baffle 110 corresponds to the first cross-flow groove 54 of the earlier-described baffle 10). Those identical elements will not be separately explained here.

The primary difference in the second embodiment of the baffle 110 is the relative size of the central bore 126 compared to the annular first groove 140 and annular second grooves 142 in the rear bell portion 114. The central bore 126 is larger in cross-sectional width than the first and second grooves 140, 142. Additionally, a baffle stack (not shown) including a plurality of these baffles 110 may not rotate each successive baffle 180 degrees from adjacent baffles in the baffle stack. The baffle stack of this embodiment may also be welded together or into an outer tubular shell so that the baffle stack cannot be disassembled. A similar arrangement of a welded, consistent orientation baffle stack will be described with respect to the next embodiment of a baffle 210, below. In any event, the X-shaped baffles 110 are still stronger in resisting the forces of the pressurized burning gases behind a .45 ACP caliber projectile and more effective in reducing the noise level of muzzle blast than a comparable length of K-baffles in a baffle stack.

A third embodiment of a baffle 210 for use in a firearm sound suppressor is illustrated in FIGS. 12-17. The baffle 210 is configured specifically for use with 9×19 millimeter ammunition, but one of ordinary skill in the art will appreciate that the baffle 210 could be designed for other sizes of projectiles. The baffle 210 of the third embodiment includes many of the same elements previously described in detail in the first and second embodiments of the baffle 10, 110, and these features also effectively reduce the noise level of a muzzle blast from a 9×19 millimeter firearm. Each of the elements repeated from the first embodiment of the baffle 10 are provided with the same reference number in the 200's (for example, the first cross-flow groove 254 of the baffle 210 corresponds to the first cross-flow groove 54 of the earlier-described baffle 10). Those identical elements will not be explained here.

Unlike the first two embodiments, the baffle 210 includes a rear bell portion 214 and a forward bell portion 216 that are generally hemispherical in shape, and more specifically, truncated hemispheres. As shown most clearly in FIGS. 13 and 16, the curved profiles of the rear bell portion 214 and the forward bell portion 216 continue to provide a generally X-shaped baffle 210. The rear bell portion 214 of this embodiment extends for a longer length in the longitudinal direction (along the longitudinal axis 212) than the forward bell portion 216. Consequently, the rear end 32 of the rear bell portion 214 is larger in cross-section than the forward end 66 of the forward bell portion 216. The rear end 32 of the rear bell portion 214 further defines an annular lip 286 adjacent to the outer peripheral edge 236. The annular lip 286 corresponds in size to the cross-sectional size of the forward end 66 of the forward bell portion 216. Therefore, when the baffle 210 is used in a baffle stack 290 (described in further detail with respect to FIG. 18, below), the outer peripheral edge 264 of the forward bell portion 216 nests within the annular lip 286 of the rear bell portion 214 of an adjacent baffle 210.

Figure 17:
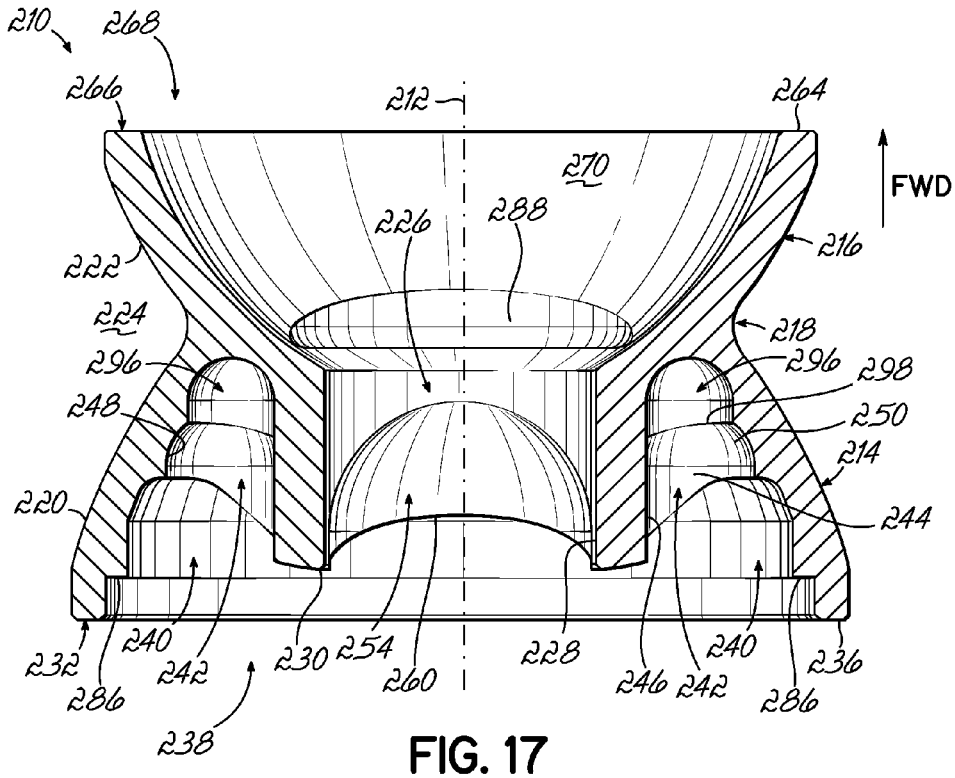
FIG. 17 is a longitudinal sectional top view of the baffle of FIG. 12.

Another difference for the baffle 210 of this embodiment is that the central bore 226 is sized for 9×19 millimeter projectiles, so the central bore 226 is again larger in cross-sectional width than the annular first groove 240 and annular second grooves 242 (see FIG. 17). As shown most clearly in FIGS. 15-17, the forward bell portion 216 further includes a crescent-shaped groove 288 cut deeper into the forward bell interior surface 270 toward the waist portion 218. The crescent-shaped groove 288 partially surrounds the central bore 226 on an opposing side from the second cross-flow groove 274. The crescent-shaped groove 288 increases the effectiveness of the baffle 210 by increasing the total area for pressurized gas expansion and by further causing turbulent flow within the forward bell portion 216.

There is more room in the rear bell portion 214 for groove cuts because of the longer length of the rear bell portion 214 compared to previous embodiments. Thus, a pair of annular third grooves 296 is cut deeper into the rear bell portion 214 towards the waist portion 218 at the pair of annular second grooves 242. The third grooves 296 are smaller than the second grooves 242 and define a groove edge 298 with the second grooves 242. In operation, the baffle 210 of the third embodiment effectively absorbs heat and kinetic energy of burning pressurized gases following a fired projectile by allowing the gases to expand, breaking up the flow of gases, creating turbulence and cross-flows in the gases, and separating the gases into different areas or chambers defined by the baffle 210.

Figure 18:
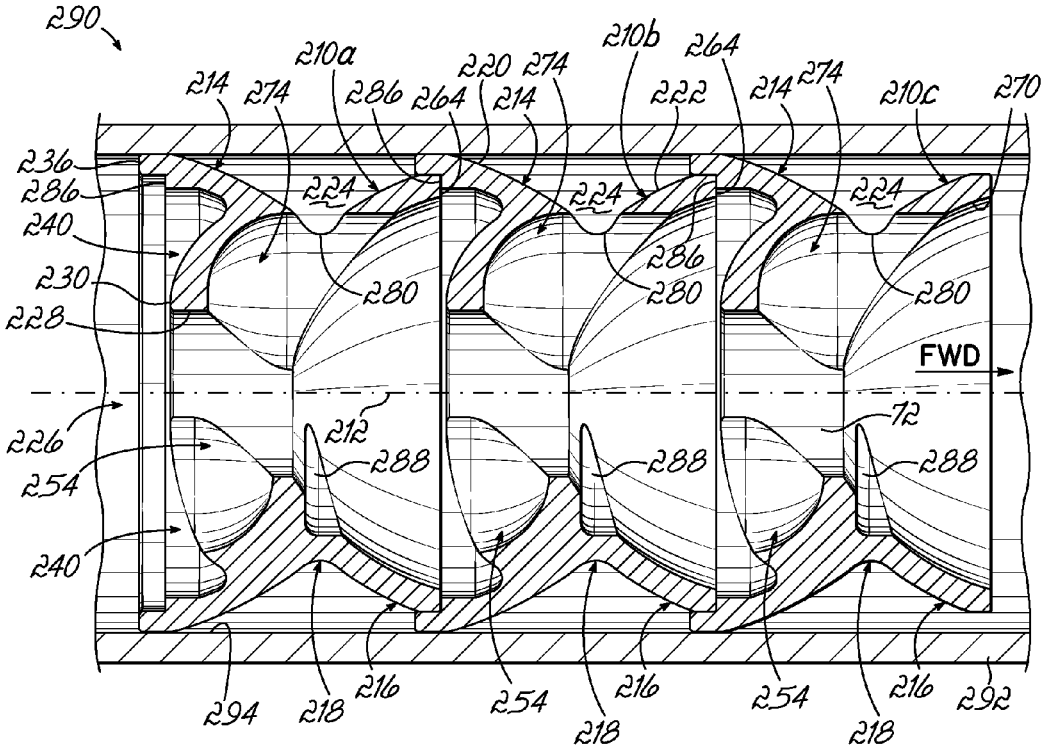
FIG. 18 is a longitudinal sectional side view of a baffle stack including multiple baffles of the embodiment of FIGS. 12-17.

FIG. 18 illustrates another embodiment of a baffle stack 290 for use in a firearm sound suppressor. The baffle stack 290 is illustrated with three baffles 210*a*, 210*b*, 210*c* of the third embodiment illustrated in series along the longitudinal axis 212, although one of ordinary skill in the art will recognize that the baffle stack 290 may include more or fewer baffles 210 within the scope of this invention. The baffle stack 290 again includes an outer tubular shell 292 with an interior surface 294 disposed about the longitudinal axis 212. Each of the baffles 210*a*, 210*b*, 210*c* is typically welded or otherwise permanently coupled to the outer tubular shell 292 such that the baffle stack 290 cannot be disassembled. The baffles 210*a*, 210*b*, 210*c* include all of the features previously described with respect to FIGS. 12-17. As described previously, the outer peripheral edge 264 of the forward bell portion 216 of a first baffle 210*a* nests within the annular lip 286 of the rear bell portion 214 of a second baffle 210*b*, and so on. Consequently, the baffle stack 290 forms a continuous series of passages and chambers for the pressurized burning gases to expand and be redirected.

Similar to other embodiments, the first baffle 210*a* or "blast baffle" may be formed from steel, while subsequent baffles 210*b*, 210*c* in the baffle stack 290 may be formed from aluminum. One of ordinary skill in the art will appreciate that in alternative embodiments, more of the baffles 210 in the baffle stack 290 may be formed from steel or other materials within the scope of this invention. In this baffle stack 290, the rotational orientation of each baffle 210 remains the same along the longitudinal axis 212. In this regard, the first cross-flow groove 254 of the first baffle 210*a* directs flow generally upwardly, as does the first cross-flow groove 254 of the second baffle 210*b*. Although the generally X-shaped baffles 210 are longer along the longitudinal axis 212 than conventional K-baffles, the X-shaped baffles 210 are stronger in resisting the forces of the pressurized burning gases and more effective in reducing the noise level of muzzle blast than a comparable length of K-baffles in a baffle stack.

While the present invention has been illustrated by the description of the embodiment thereof, and while the embodiment has been described in considerable detail, it is not the intention of the applicant to restrict or in any way limit the scope of the appended claims to such detail. Additional advantages and modifications will readily appear to those skilled in the art. For example, the generally frusto-conical shape of the rear and forward bell portions 14, 16 of the (.22 caliber) first embodiment of the baffle 10 could be formed with a generally truncated hemispherical shape, and the generally hemispherical shape of the rear and forward bell portions 214, 216 of the (9×19 millimeter Parabellum) third embodiment of the baffle 210 could be formed with a generally frusto-conical shape. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. A baffle configured for use in a firearm sound suppressor, the baffle having a longitudinal axis along which in use a projectile passes from a rearward side to a forward side, the baffle comprising:

a rear bell portion including a first annular exterior surface, the rear bell portion decreasing in cross-section along the longitudinal axis toward the forward side;

a forward bell portion including a second annular exterior surface, the forward bell portion increasing in cross-section along the longitudinal axis toward the forward side;

a waist portion defined between and connecting the rear bell portion and the forward bell portion;

a central bore defining an annular interior surface extending along the longitudinal axis and substantially through the rear bell portion, the central bore sized to receive a projectile traveling along the longitudinal axis; and a flow aperture disposed through the waist portion and enabling fluid communication between the central bore and an exterior chamber at least partially defined by the first and second annular exterior surfaces, wherein the forward bell portion includes a forward end defining the forward side of the baffle, and wherein the forward bell portion is hollowed to define a forward bell interior surface extending from the forward end to the waist portion, wherein the rear bell portion includes a rear end having an outer peripheral edge and defining the rearward side of the baffle, the central bore includes a rear peripheral edge, and the rear bell portion further includes an annular first groove cut into the rear bell portion between the outer peripheral edge of the rear bell portion and the rear peripheral edge of the central bore, and wherein the rear bell portion further includes a pair of partially-annular second grooves cut deeper into the rear bell portion from the first groove, the second grooves each defining a groove sidewall parallel to the longitudinal axis and at least partially adjacent to the central bore.

2. The baffle of claim 1, wherein the rear bell portion further includes a first cross-flow groove cut deeper into the rear bell portion from the first groove between the partially-annular second grooves, the first cross-flow groove also being cut through the annular interior surface of the central bore so as to create cross flow of fluid across the central bore toward the flow aperture.

3. The baffle of claim 2, wherein the baffle further includes a second cross-flow groove in fluid communication with the flow aperture and cut into the waist portion and rear bell portion from the forward bell interior surface so as to receive cross flow of fluid from the first cross-flow groove.

4. The baffle of claim 3, wherein the forward bell interior surface further includes a crescent-shaped groove surrounding the central bore on an opposing side of the central bore from the flow aperture and second cross-flow groove.

5. A baffle configured for use in a firearm sound suppressor, the baffle having a longitudinal axis along which in use a projectile passes from a rearward side to a forward side, the baffle comprising:

a rear bell portion including a first annular exterior surface, the rear bell portion decreasing in cross-section along the longitudinal axis toward the forward side;

a forward bell portion including a second annular exterior surface, the forward bell portion increasing in cross-section along the longitudinal axis toward the forward side;

a waist portion defined between and connecting the rear bell portion and the forward bell portion;

a central bore defining an annular interior surface extending along the longitudinal axis and substantially through the rear bell portion, the central bore sized to receive a projectile traveling along the longitudinal axis; and a flow aperture disposed through the waist portion and enabling fluid communication between the central bore and an exterior chamber at least partially defined by the first and second annular exterior surfaces, wherein the rear bell portion and the forward bell portion are substantially equal in longitudinal length.

6. The baffle of claim 5, wherein the central bore is sized for .22 caliber ammunition.

7. The baffle of claim 5, wherein the central bore is sized for .45 ACP caliber ammunition.

8. The baffle of claim 5, wherein the exterior surfaces of the rear bell portion and the forward bell portion are generally shaped as truncated hemispheres.

9. A baffle configured for use in a firearm sound suppressor, the baffle having a longitudinal axis along which in use a projectile passes from a rearward side to a forward side, the baffle comprising:

a rear bell portion including a first annular exterior surface, the rear bell portion decreasing in cross-section along the longitudinal axis toward the forward side;

a forward bell portion including a second annular exterior surface, the forward bell portion increasing in cross-section along the longitudinal axis toward the forward side;

a waist portion defined between and connecting the rear bell portion and the forward bell portion;

a central bore defining an annular interior surface extending along the longitudinal axis and substantially through the rear bell portion, the central bore sized to receive a projectile traveling along the longitudinal axis; and a flow aperture disposed through the waist portion and enabling fluid communication between the central bore and an exterior chamber at least partially defined by the first and second annular exterior surfaces, wherein the rear bell portion is longer along the longitudinal axis than the forward bell portion, and the rear bell portion further includes a rear end and an annular lip disposed at the rear end, the rear end defining the rearward side of the baffle.

10. The baffle of claim 9, wherein the lip includes an inner edge and the forward bell portion includes a forward end defining the forward side of the baffle and having an outer peripheral edge corresponding in size to the inner edge of the annular lip disposed at the rear end of the rear bell portion.

11. The baffle of claim 10, wherein the central bore is sized for 9×19 millimeter Parabellum ammunition.

12. A baffle stack for use in a firearm sound suppressor having an outer tubular shell with an interior surface and extending along a longitudinal axis, the baffle stack comprising:

a plurality of baffles configured to contact the interior surface of the outer tubular shell and disposed in series along the longitudinal axis, each of the baffles further comprising:

a rear bell portion including a first annular exterior surface, the rear bell portion decreasing in cross-section along the longitudinal axis in a forward direction;

a forward bell portion including a second annular exterior surface, the forward bell portion increasing in cross-section along the longitudinal axis in the forward direction;

a waist portion defined between and connecting the rear bell portion and the forward bell portion;

a central bore defining an annular interior surface extending along the longitudinal axis and substantially through the rear bell portion, the central bore sized to receive a projectile traveling along the longitudinal axis; and a flow aperture disposed through the waist portion and enabling fluid communication between the central bore and an exterior chamber at least partially defined by the first and second annular exterior surfaces, wherein the forward bell portion of each baffle includes a forward end, and wherein the forward bell portion is hollowed to define a forward bell interior surface extending from the forward end to the waist portion, wherein the rear bell portion of each baffle includes a rear end having an outer peripheral edge, the central bore includes a rear peripheral edge, and the rear bell portion further includes an annular first groove cut into the rear bell portion between the outer peripheral edge of the rear bell portion and the rear peripheral edge of the central bore, and wherein the rear bell portion of each baffle further includes a pair of partially-annular second grooves cut deeper into the rear bell portion from the first groove, the second grooves each defining a groove sidewall parallel to the longitudinal axis and at least partially adjacent to the central bore.

13. The baffle stack of claim 12, wherein at least one baffle of the plurality of baffles is formed from stainless steel, and other baffles in the plurality of baffles are formed from aluminum.

14. The baffle stack of claim 13, wherein a first baffle is formed from stainless steel and all baffles in the forward direction from the first baffle are formed from aluminum.

15. The baffle stack of claim 12, wherein the rear bell portion of each baffle further includes a first cross-flow groove cut deeper into the rear bell portion from the first groove between the partially-annular second grooves, the first cross-flow groove also being cut through the annular interior surface of the central bore so as to create cross flow of fluid across the central bore toward the flow aperture.

16. The baffle stack of claim 15, wherein each baffle further includes a second cross-flow groove in fluid communication with the flow aperture and cut into the waist portion and rear bell portion from the forward bell interior surface so as to receive cross flow of fluid from the first cross-flow groove.

17. The baffle stack of claim 16, wherein the flow aperture, first cross-flow groove, and second cross-flow groove of each baffle are in the same orientation as adjacent baffles.

18. The baffle stack of claim 17, wherein the central bore of each baffle is sized for .45 ACP caliber ammunition.

19. The baffle stack of claim 17, wherein the central bore of each baffle is sized for 9×19 millimeter Parabellum ammunition.

20. The baffle stack of claim 16, wherein the flow aperture, first cross-flow groove, and second cross-flow groove of each baffle are rotated in orientation 180 degrees from adjacent baffles.

21. The baffle stack of claim 20, wherein the central bore of each baffle is sized for .22 caliber ammunition.

* * * * *